US009011031B2

(12) United States Patent
Jang

(10) Patent No.: US 9,011,031 B2
(45) Date of Patent: Apr. 21, 2015

(54) MULTI-APPLICATOR TOOL

(75) Inventor: Kyoung Ae Jang, Atlanta, GA (US)

(73) Assignee: Anisa International, Inc., Atlanta, GA (US)

( * ) Notice: Subject to any disclaimer, the term of this patent is extended or adjusted under 35 U.S.C. 154(b) by 411 days.

(21) Appl. No.: 13/473,973

(22) Filed: May 17, 2012

(65) Prior Publication Data

US 2012/0294666 A1 Nov. 22, 2012

Related U.S. Application Data

(60) Provisional application No. 61/487,067, filed on May 17, 2011.

(51) Int. Cl.

| | |
|---|---|
| ***B43K 21/20*** | (2006.01) |
| ***A45D 40/24*** | (2006.01) |
| ***A45D 34/00*** | (2006.01) |
| ***A45D 34/04*** | (2006.01) |
| ***A46B 5/00*** | (2006.01) |
| ***A46B 17/04*** | (2006.01) |

(52) U.S. Cl.

CPC ..... *A45D 40/24* (2013.01); *A45D 34/00* (2013.01); *A45D 34/042* (2013.01); *A46B 5/0095* (2013.01); *A46B 17/04* (2013.01)

(58) Field of Classification Search

CPC ..... A45D 40/24; A46B 5/0095
USPC ..... 401/17–20, 57, 100; 132/216, 317; 206/515–520, 229, 385, 581, 823
See application file for complete search history.

(56) References Cited

U.S. PATENT DOCUMENTS

| | | | | |
|---|---|---|---|---|
| 4,238,163 | A * | 12/1980 | Hung | 401/89 |
| 5,881,742 | A | 3/1999 | Hunsberger | |
| 6,568,529 | B2 * | 5/2003 | McMurrey | 206/385 |
| 7,650,895 | B2 * | 1/2010 | Werner | 132/318 |
| 7,997,820 | B2 * | 8/2011 | Bouix et al. | 401/35 |
| 2008/0283083 | A1 | 11/2008 | Piao | |
| 2010/0017990 | A1 | 1/2010 | Piao | |

FOREIGN PATENT DOCUMENTS

| | | |
|---|---|---|
| EP | 2 281 476 A1 | 2/2011 |
| KR | 101 006 908 B1 | 1/2011 |

OTHER PUBLICATIONS

International Searching Authority, International Search Report and Written Opinion for International Application No. PCT/US2012/038356, mailed Jan. 21, 2013, 9 pages, Korean Intellectual Property Office.

European Patent Office Invitation Pursuant to Rule 62a(1) EPC, EPO Appn No. 12 785 525.2-1653, mailed Sep. 29, 2014, 3 pages, EPO, The Netherlands.

European Patent Office Extended Search Report, EPO Appn. No. 12 785 525.2-1653, mailed May 2, 2015, 12 pages, EPO, The Netherlands.

* cited by examiner

*Primary Examiner* — Jennifer C Chiang
(74) *Attorney, Agent, or Firm* — Gronholm Patent Services, LLC

(57) ABSTRACT

A plurality of multi-applicator tools are provided, including tools which include magnetically attachable and detachable application brushes or the like. Some embodiments include a linear arrangement of brushes in a generally elongate tool configuration. Other embodiments include a central base into which application brushes fit within. Various appearances are likewise provided.

15 Claims, 10 Drawing Sheets

Multi-applicator tool 300

Multi-applicator tool 350

Multi-Applicator Tool 500

Multi-Applicator Tool 500

Multi-Applicator Tool 550

Multi-Applicator Tool 600

Multi-Applicator Tool 600 (exploded)

Multi-Applicator Tool 600 (cross section)

Multi-Applicator Tool 700 (exploded)

Multi-Applicator Tool 700

Side

Top

Multi-Applicator Tool 800

Multi-Applicator Tool 800

Multi-Applicator Tool 800

Parts of Multi-Applicator Tool 800

Multi-Applicator Tool 800

Multi-Applicator Tool 800

MULTI-APPLICATOR TOOL

CROSS-REFERENCE TO RELATED APPLICATION

This application claims the benefit of U.S. Provisional Patent Application No. 61/487,067 filed May 17, 2011, which is incorporated herein by reference in its entirety.

BACKGROUND OF THE INVENTION

Cosmetic brushes vary greatly in size, shape, and function, and therefore a variety of brushes is often required in a typical makeup application. The application of eye makeup, for example, may require a rounded brush or sponge applicator for applying a base eyeshadow over the eyelid, a pointed brush for defining the crease of the eyelid with another shade of eyeshadow, and a flattened brush for lining the eye. Because brushes known in the art typically have a single brush head, three separate functions would require three separate makeup brushes. Not only does having multiple makeup brushes create clutter, but it also imposes a burden when traveling.

To solve the above problem, a brush with one brush head on each end of a handle is currently available. However, these brushes have the following disadvantages. First, if the brush has delicate heads on both ends, many storage options are unavailable. For example, it cannot be stored upright in a canister, placed in a fitted pocket, or held by an elastic banded pouch, as the brush head on the inserting end risks damage in each of these scenarios. Second, these brushes can have a maximum of two brush heads on a single handle. Accordingly, there is a need in the art for a cosmetic applicator capable of having multiple brush heads serving a variety of functions.

BRIEF SUMMARY OF INVENTIVE CONCEPTS

An object of the invention is to provide a cosmetic tool with a plurality of applicators that can be used for various types of cosmetics applications. According to one aspect of the invention, the applicators each comprise a cavity that is adapted to cover at least part of another applicator. According to another aspect of the invention, the applicators each further comprise a first and second magnetic component. According to another aspect of the invention, the first magnetic component of a first applicator is adapted for mating with a second magnetic component of another applicator.

Another object of the invention is to provide a cosmetic tool with a plurality of brush heads that can each be covered when not in use. According to one aspect of the invention, a brush head may be covered by a component holding another brush head. According to another aspect of the invention, the brush heads may all be covered by a receptacle. According to another aspect of the invention, the receptacle may be adapted for magnetically mating with a magnetic element on each of the brush heads.

According to another aspect of the invention, an applicator member is provided which is configured to interact with another similar applicator member having the same components claimed herein, the applicator member comprising: an elongate applicator head having a longitudinal axis substantially common to the longitudinal axis of the elongate base, and including an elongate applicator element; and an elongate base having a longitudinal axis and also having a first end and a second end opposing the first end, the applicator head fixed proximate the first end of the base such that an exposed shoulder surface portion is defined by the first end of the base, the first exposed shoulder surface being at least partially defined by a first attraction element itself also being part of the elongate base, the second end of the base defining an exposed peripheral end surface portion being at least partially defined by a second attraction element itself also being part of the elongate base, the second end of the base also defining an open elongate cavity having a longitudinal axis substantially common to the longitudinal axis of the elongate base, the exposed peripheral end surface portion being peripherally located about the opening of the elongate cavity, the first attraction element of the applicator member configured to be selectively attached and selectively detached from a second attraction element of the another similar applicator member such that the applicator element of the applicator member can fit within a cavity of the another similar applicator member during the attachment of the first and second attraction elements by an attraction force, the second attraction element of the applicator member configured to be selectively attached and selectively detached from a first attraction element of the another similar applicator member such that the cavity of the applicator member allows an applicator element of the another similar applicator member to fit therein during the attachment of the first and second attraction elements by an attraction force.

According to another aspect of the invention, an applicator member is provided which is configured to interact with another similar applicator member having the same components claimed herein, the applicator member comprising: an elongate applicator head having a longitudinal axis substantially common to the longitudinal axis of the elongate base, and including an elongate applicator element and an elongate mounting member; and an elongate base having a longitudinal axis and also having a first end and a second end opposing the first end, the applicator head fixed proximate the first end of the base such that an exposed shoulder surface portion is defined by the first end of the base, the first exposed shoulder surface being at least partially defined by a first attraction element itself also being part of the elongate base, the second end of the base defining an exposed peripheral end surface portion being at least partially defined by a second attraction element itself also being part of the elongate base, the first end of the base also defining an open elongate cavity having a longitudinal axis substantially common to the longitudinal axis of the elongate base and configured to accept at least a portion of the elongate mounting member, the exposed shoulder surface portion being peripherally located about the opening of the elongate cavity, the second end of the base also defining an open elongate cavity having a longitudinal axis substantially common to the longitudinal axis of the elongate base, the exposed peripheral end surface portion being peripherally located about the opening of the elongate cavity, the first attraction element of the applicator member configured to be selectively attached and selectively detached from a second attraction element of the another similar applicator member such that the applicator element of the applicator member can fit within a cavity of the another similar applicator member during the attachment of the first and second attraction elements by an attraction force, the second attraction element of the applicator member configured to be selectively attached and selectively detached from a first attraction element of the another similar applicator member such that the cavity of the applicator member allows an applicator element of the another similar applicator member to fit therein during the attachment of the first and second attraction elements by an attraction force.

According to another aspect of the invention, a multi-applicator tool member is provided including a plurality of applicators configured to interact with and attach to each other in order to combine to provide the tool, the multi-applicator tool member comprising: A) a first applicator itself including: 1) an elongate applicator head having a longitudinal axis substantially common to the longitudinal axis of the elongate base, and including an elongate applicator element and an elongate mounting member; and 2) an elongate base having a longitudinal axis and also having a first end and a second end opposing the first end, the applicator head fixed proximate the first end of the base such that an exposed shoulder surface portion is defined by the first end of the base, the first exposed shoulder surface being at least partially defined by a first attraction element itself also being part of the elongate base, the second end of the base defining an exposed peripheral end surface portion being at least partially defined by a second attraction element itself also being part of the elongate base, the first end of the base also defining an open elongate cavity having a longitudinal axis substantially common to the longitudinal axis of the elongate base and configured to accept at least a portion of the elongate mounting member, the exposed shoulder surface portion being peripherally located about the opening of the elongate cavity, the second end of the base also defining an open elongate cavity having a longitudinal axis substantially common to the longitudinal axis of the elongate base, the exposed peripheral end surface portion being peripherally located about the opening of the elongate cavity; and B) a second applicator itself including the same limitations as does the first applicator, the first attraction element of the first applicator member configured to be selectively attached and selectively detached from the second attraction element of the second applicator member such that the applicator element of the first applicator member fits within a cavity of the another similar applicator member during the attachment of the first attraction element of the first applicator member and the second attraction element of the second applicator member by an attraction force, the second attraction element of the first applicator member configured to be selectively attached and selectively detached from a first attraction element of the second applicator member such that the cavity of the first applicator member allows an applicator element of the second applicator member to fit therein during the attachment of the second attraction element of the first applicator member and the first attraction element of the second applicator member by an attraction force.

According to another aspect of the invention, a multi-applicator tool member is provided including a plurality of applicators configured to interact with and attach to a singular central base, the multi-applicator tool member comprising: a first applicator; a second applicator; and a base configured to magnetically attach to and retain both the first and second applicators.

BRIEF DESCRIPTION OF THE DRAWINGS

Reference will now be made to the accompanying drawings, which are not necessarily drawn to scale, and wherein.

DETAILED DESCRIPTION OF THE INVENTION

Various embodiments of the present invention provide a cosmetic tool with a plurality of brush heads. The present invention now will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Element List

Here follows an element list.

| | |
|---|---|
| 10 | Applicator |
| 11 | Brush Head |
| 12 | Bristles |
| 13 | Ferrule |
| 14 | Mounting member |
| 15 | Base |
| 16 | First magnetic ring |
| 17 | Shoulder |
| 18 | Cavity |
| 20 | Second magnetic ring |
| 30 | Cap |
| 40 | Magnet |
| 100 | Multi-Applicator tool |
| 200 | Multi-Applicator tool |
| 250 | Multi-applicator tool |
| 300 | Multi-applicator tool |
| 350 | Multi-applicator tool |
| 500 | Multi-applicator tool |
| 600 | Multi-applicator tool |
| 700 | Multi-applicator tool |
| 800 | Multi-applicator tool |
| 1010 | Applicator |
| 1012 | Bristles |
| 1013 | Ferrule |
| 1014 | Mounting member |
| 1015 | Base |
| 1016 | First magnetic ring |
| 1020 | Second magnetic ring |
| 1030 | Cap |
| 1040 | Magnet |

Applicator Unit

Figure 2A:
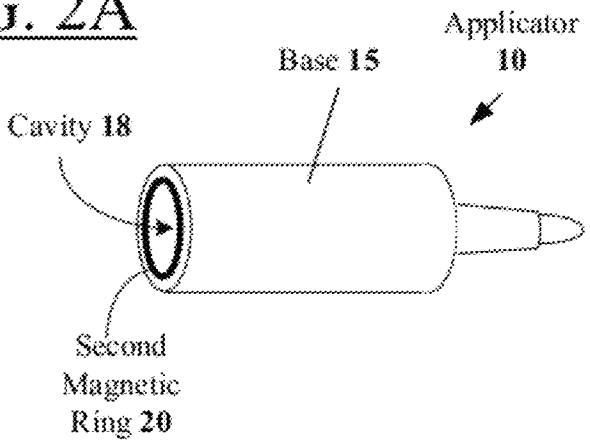
FIG. 2A shows a perspective view showing the bottom of an applicator member 10 for use as a part of a multi-applicator tool according to one embodiment of the present invention.
Figure 2B:
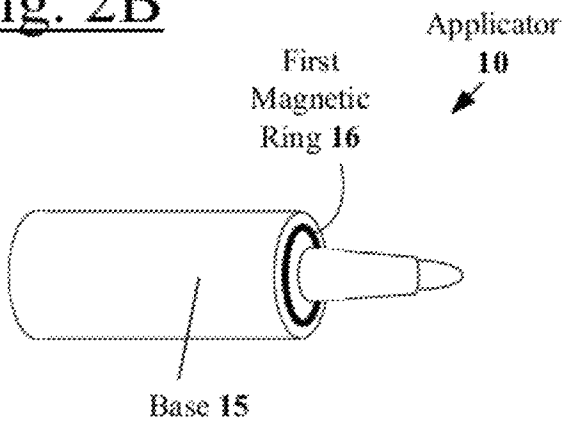
FIG. 2B shows a perspective view showing the top of an applicator member 10 for a multi-applicator tool according to one embodiment of the present invention.
Figure 1:
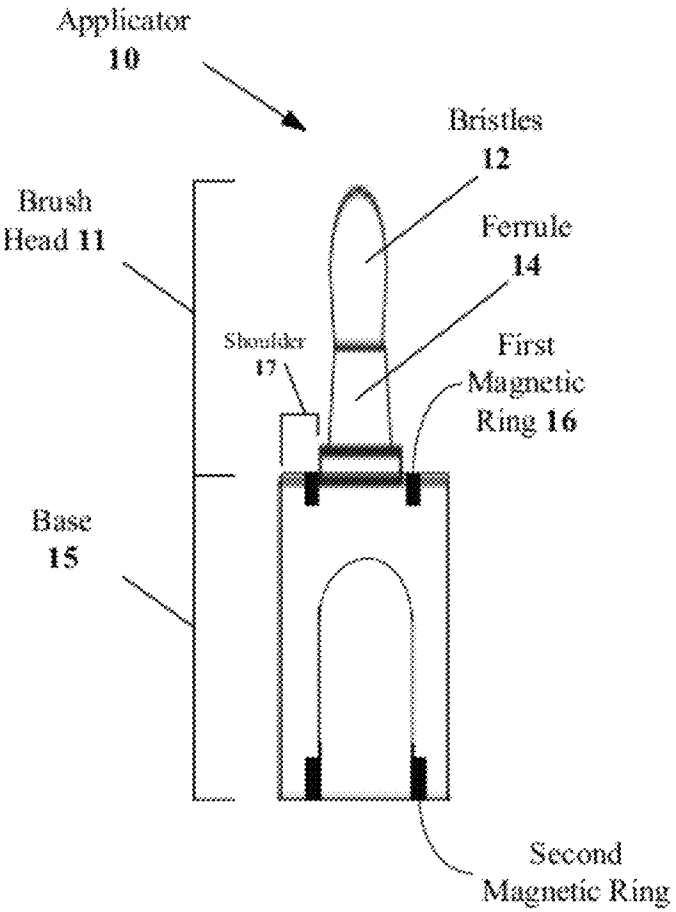
FIG. 1 shows a side sectional view of an applicator member 10 for a multi-applicator tool according to one embodiment of the present invention.
Figure 3:
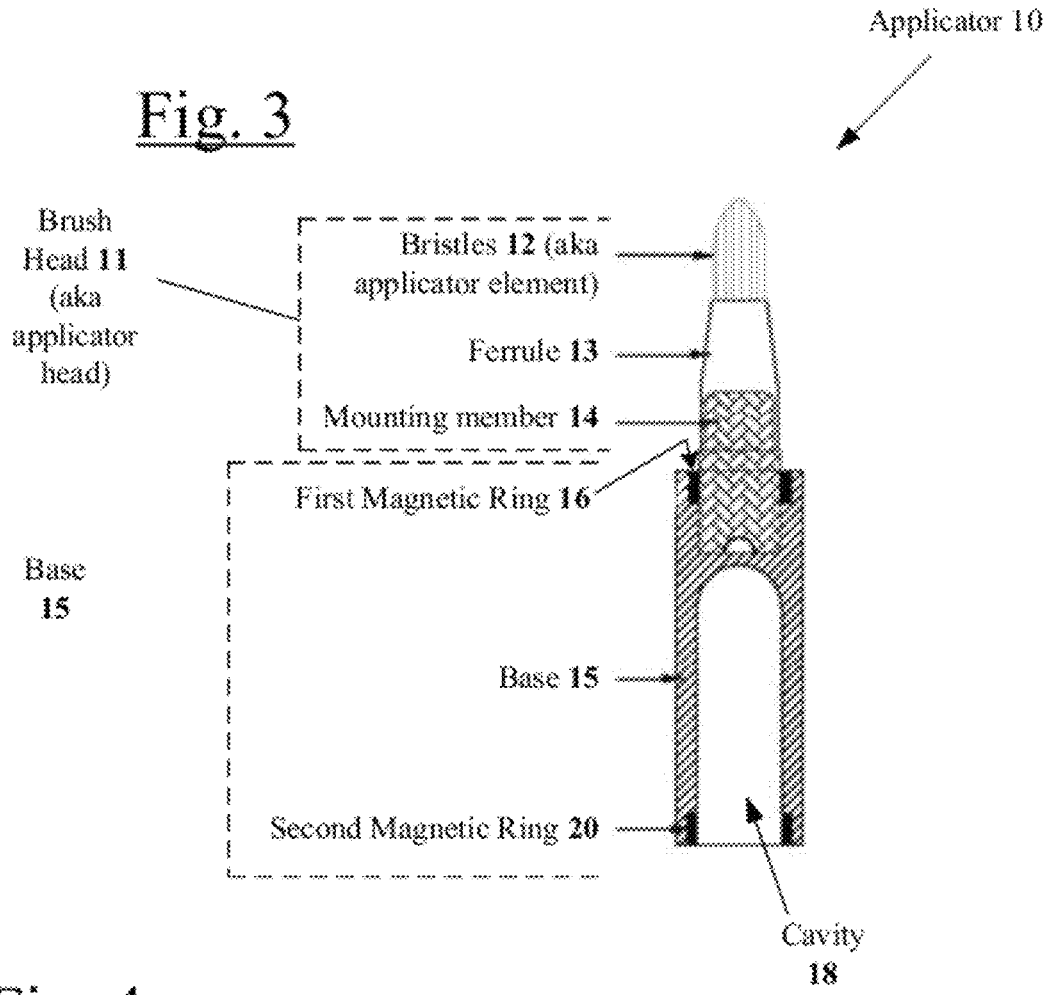
FIG. 3 another sectional view of an applicator member 10 for a multi-applicator tool according to one embodiment of the present invention, which is similar to the view of FIG. 1 except that more elements are in cross section.

FIGS. 1-3 provide several views of an elongate applicator member (hereinafter applicator 10) according to an embodiment of the present invention. As shown in FIG. 1, the applicator 10 is comprised of an elongate base 15 and an elongate brush head 11 extending from one end of the base. In the present embodiment the base is circular in transverse cross-section.

The brush head 11 includes an applicator element (in the embodiment shown, bristles 12), and also includes a ferrule 13, and a mounting member 14 (see FIG. 3). The bristles 12 are held in a conventional manner by ferrule 13, which is mounted to one end of the base 15 by use of the mounting member 14, which has one end that fits within the ferrule, another end that fits within an unnumbered hole in the base (opposite the cavity 18 discussed below), and a thicker, medial, shoulder section which allows for location of the mounting member relative to the ferrule and the base. The mounting member 14 in the present embodiment is generally circular in transverse cross-section where it joins the base 15 and has a smaller diameter than the base 15, leaving an exposed annular shoulder 17 on the base surrounding the attachment point of the ferrule 13. The base 15 includes a first magnetic ring 16, a second magnetic ring 20, and defines shoulder 17 and a cavity 18.

At least part of the exposed shoulder 17 (see FIG. 1) is magnetic. For example, as shown in FIGS. 1-3, the magnetic portion of the exposed shoulder 17 in the present embodiment is the first magnetic ring 16 embedded into the base 15. The first magnetic ring 16 is aligned so that its one exposed edge and the remaining portion of the shoulder 17 form a generally planar mating surface.

The second magnetic ring 20 is situated on the distal end of the base 15 (the end opposite the brush head) and may have dimensions that are similar, or identical, to the first magnetic ring 16. For example, in the present embodiment, the second magnetic ring 20 also has an outer diameter of approximately 10 millimeters and an inner diameter of approximately 8 millimeters.

As shown in FIG. 1, the exposed end of the second magnetic ring 20 lies flush with the distal end of the base 15, the two ends forming a generally planar annular surface. As shown for example in FIG. 2, the second magnetic ring 20 also frames an opening for a cavity 18 extending into the base 15. This end of the base could be said to define the elongate cavity. The configuration of the cavity 18, as well as the magnetic orientations and strengths of the first and second magnetic rings 16, 20, are described in detail below.

Multi-Applicator Tool

Figure 4:
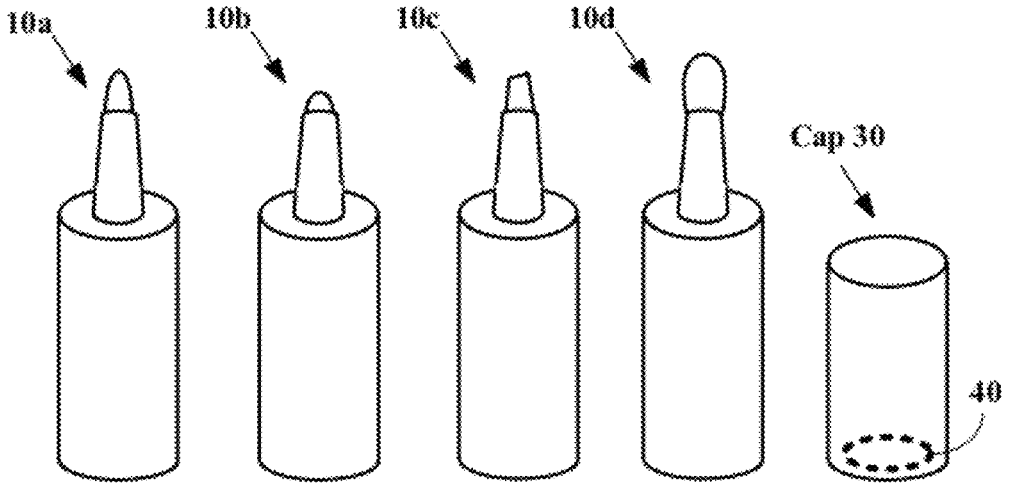
FIG. 4 shows a side perspective view of the components of a disassembled multi-applicator tool according to one embodiment of the present invention.

FIG. 4 shows a set of applicators 10*a*, 10*b*, 10*c*, 10*d*, each having the components described above, as well as a cap 30 configured for placement over any of the applicators. The applicators 10*a*, 10*b*, 10*c*, 10*d* and the cap 30 collectively form a multi-applicator tool 100 according to one embodiment of the present invention.

Figure 5:
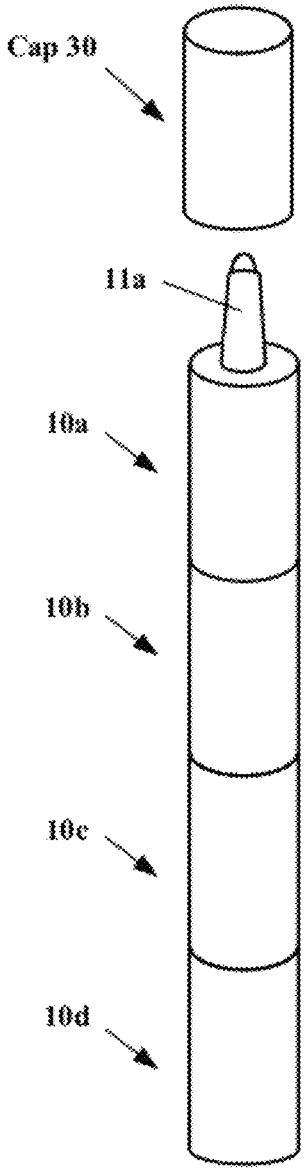
FIG. 5 shows a side perspective view of an uncapped multi-applicator tool according to one embodiment of the present invention.

In the present embodiment, the applicators 10*a*, 10*b*, 10*c*, 10*d* can be linearly assembled in any order. As shown in FIG. 5, the multi-applicator tool 100 can be configured for use (i.e., without the cap 30, exposing a brush head 11*a* for use). However, the multi-applicator tool 100 may be arranged so that any of the other brush heads is exposed for use.

Therefore, it may be seen that multi-applicator tool 100 has the advantage of being able to serve a plurality of cosmetics application functions without requiring a plurality of individual cosmetic applicators. That is, the multi-applicator tool 100 serves each of these functions but can be handled, stored, and transported as a single unit.

Each applicator 10*a*, 10*b*, 10*c*, and 10*d* serves a different function in a cosmetics application. For example, in the present embodiment, the applicators are each adapted for a particular type of eye makeup application. In particular, applicator 10*a* has a pointed bristle arrangement and can be used to define the crease of the eye. Applicator 10*b* in the present embodiment has relatively short, compactly arranged bristles that can be used to smudge eye liners and shadows. Applicator 10*c* has an angular bristle arrangement and can be used for precise applications, such as lining the eyes. Applicator 10*d* is a sponge applicator that can be used to apply pressed eye shadows.

However, in various other embodiments, applicators may be adapted for other types of applications such as for the brows or lips. In addition, the applicators may be adapted in size and shape to accommodate larger brush heads, such as for the application of foundation, blush, or bronzer. In other embodiments, at least some of the applicators may be adapted for the same type of makeup application. For example, a cosmetics tool may have two or more applicators with the same type of bristles so that two types of product could be applied without cross-contamination.

Figure 6:
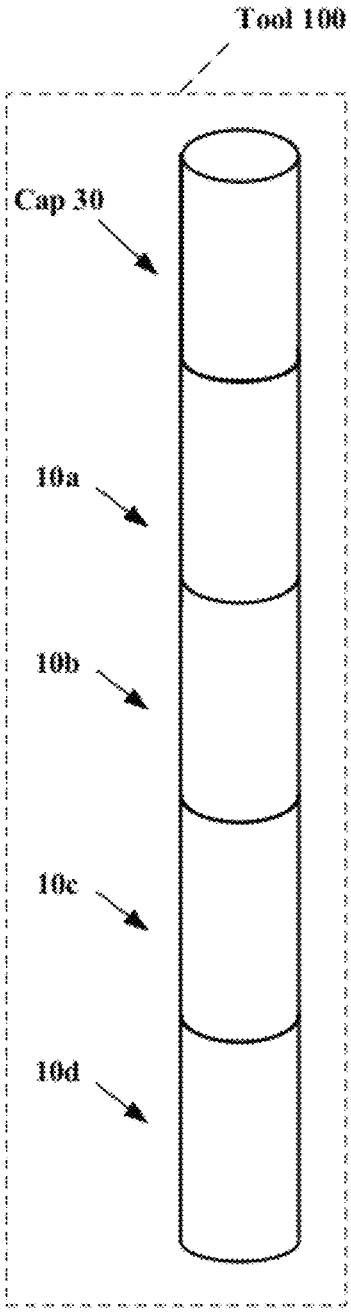
FIG. 6 shows a side perspective view of a capped multi-applicator tool 100 according to one embodiment of the present invention.

As shown in FIG. 6, the multi-applicator tool 100 can be configured for storage by attaching the cap 30. Therefore, another advantage of the cosmetic tool 100 is that every brush head 10*a*, 10*b*, 10*c*, and 10*d* can be covered, allowing for ease of transportability. For example, in the arrangement shown in FIG. 6, brush head 12*b* is covered by cavity 18*a* of brush head 10*b*. Other brush heads are covered by the cavity of other brush heads. In this way, the cosmetic tool 100 can be stored or transported as a single, protected unit, without any risk of damaging the brush heads.

Cavities

Figure 7:
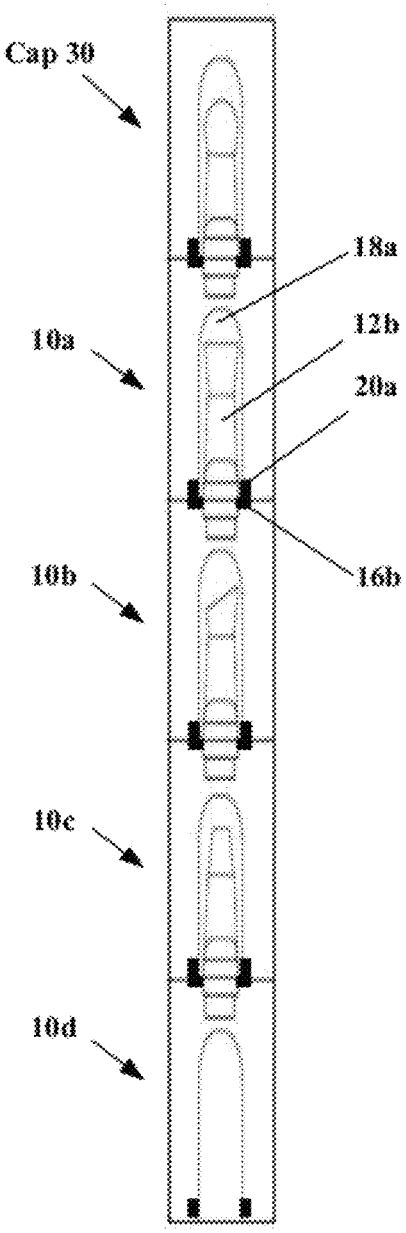
FIG. 7 shows a side sectional view of a capped multi-applicator tool according to the embodiment of the present invention of FIG. 6.

As shown in FIGS. 1 and 7, in the present embodiment of the invention, the cavity 18 in the base 15 of the applicator 10 is generally cylindrical along its depth and dimensioned to receive a brush head on another applicator.

As such, in this embodiment, the cavity 18 is dimensioned so that it can fit over any brush head in a given set of applicators without damaging the brush head. That is, the inner diameter of the cavity should be greater than the widest brush head in a given set of applicators. Furthermore, the depth of the cavity should be greater than the height of any of the brush heads. For example, with respect to the applicators 10*a*, 10*b*, 10*c*, 10*d* shown in FIG. 4, the bristles 12*a*, 12*b*, 12*c*, 12*d* have varying lengths and therefore the brush heads 11*a*, 11*b*, 11*c*, 11*d* have varying heights. The tallest brush head 11*a* has a height of approximately 26 millimeters, and each of the cavities 18*a* has a depth of approximately 30 millimeters. In other embodiments, the applicators forming a cosmetic tool may have cavities of different depths.

For example, in the present embodiment, applicator 10*a* can be stacked on top of any of the applicators 10*b*, 10*c*, 10*d* shown in FIG. 4. In this way, base 15*a* of applicator 10*a* may serve as a protective enclosure for the brush head on any other applicator.

FIG. 4 also shows a cap 30 with an unshown cavity and a magnetic ring 40 shown in dotted line. The cavity in the cap 30 in the present embodiment is shaped and sized equal to the cavities 18*a*, 18*b*, 18*c*, 18*d* in the applicator units 10*a*, 10*b*, 10*c*, 10*d*. Likewise, the magnetic ring is situated around the cavity in a similar manner as the second magnetic rings 20*a*, 20*b*, 20*c*, 20*d* around the cavities 18*a*, 18*b*, 18*c*, 18*d* of the applicator units 10*a*, 10*b*, 10*c*, 10*d*. The magnetic ring 40 is configured to magnetically mate with any of the first magnetic rings 16*a*, 16*b*, 16*c*, 16*d*. In this way, the cap 30 is adapted to cover any of the applicator units 10*a*, 10*b*, 10*c*, 10*d*.

First and Second Magnetic Components

The first magnetic rings 16 are configured to either magnetically attract or be magnetically attracted to the second magnetic rings 20 when the respective applicators are linearly arranged in a mating position. That is, according to various embodiments of the present invention, one or both of the first and second magnetic rings may have its magnetic poles linearly aligned along the axis of the base. Alternatively, both the first magnetic ring and the second magnetic ring may have magnetic poles oriented in the same direction so that they each have an attractive force with respect to the other. For example, in the present embodiment, the first and second magnetic rings are both permanent magnets with poles oriented in the same direction along the linear axis.

However, in various other embodiments, the first magnetic ring could be a permanent magnet and the second magnetic ring could be comprised of a material that is attracted by a magnetic force, such as iron or steel.

In further embodiments, the second magnetic ring could be a permanent magnet, and the second magnetic ring could be comprised of a material that is attracted by a magnetic force, such as iron or steel.

Generically speaking, It should be understood that the first and second magnetic rings could be generically referenced as first and second "attraction elements", with attraction elements being defined as elements that tend to be drawn together by an attractive force when placed suitably close together. This attraction would include the magnetic attraction between two suitably polarized magnets, or between a magnet and a suitably selected metal such as iron or steel.

As may be understood, the first and second magnetic rings of the various brush heads keep the brush heads together. As an example, first magnetic ring element 16*b* (of brush head 10*b*) releasably connects relative to second magnetic ring element 20*a* (of brush head 10*a*). However, any two applicators may be joined by magnetic force between the first magnetic ring of one applicator and the second magnetic ring of the other applicator.

The first and second magnetic rings may be adapted so that separation requires a pulling force of at least 0.33 pounds-force (lbf). The pulling force required should be high enough so that the cosmetic tool is not at risk of disassembling through normal use (e.g., handling by a user during a makeup application) or transport (e.g., when being carried in a cosmetics pouch). However, the pulling force should not be so high as to require undue exertion to detach the applicator units from one another. For example, in the present embodiment, a pulling force of 0.5 to 1.8 lbf has been found to be acceptable to meet these criteria. However, in various other embodiments, depending on, for example, the type, size, or arrangement of the applicator units, pulling forces in the range of approximately 0.33 lbf to 2.0 lbf may be used.

The pulling forces between the first and second magnetic rings of various embodiments described herein allow a user to use the multi-applicator tool as a single component. A user may arrange the applicators of various embodiments so that a brush head on a first applicator is exposed, while the brush heads on the other applicators are covered. The applicators of these embodiments are all magnetically connected to form a single multi-applicator tool, and the pulling force holding the applicators together is great enough to withstand typical forces exerted on the tool by the user in applying cosmetics. For example, a user may grip the multi-applicator tool by one or more applicators without detaching or disconnecting any of the applicators. In this way, the applicators when magnetically mated form a handle for the multi-applicator tool.

Various other embodiments of the present invention, some of which are described below, also comprise magnetic components. Although they may vary in size or shape, other "first" magnetic components (e.g., 216 or 316 described below) may function in the same or similar manner as the first magnetic ring 16, and other second magnetic components (e.g., 220 or 320 described below) may function in the same or similar manner as the second magnetic ring 20. In addition, magnetic components in the caps or capping units in various other embodiments (e.g., 220 or 320) may function in the same or similar manner as the second magnetic ring 20.

Additional Features

The applicator units can have labels on their respective bases so that they can be identified when the brush heads are covered (i.e., when the cosmetic tool is in its assembled form). The labels may identify the function of the particular brush head (e.g., "crease", "smudge", "angle liner", and "sponge", as shown in FIG. 4). Alternatively, or additionally, the bases may be different colors so that a user can easily identify a particular type of brush head without looking at the label.

Furthermore, in various embodiments, the caps, bases, or other enclosures providing covering function for the brush heads or bristles may be at least in part transparent so that the brush head can be identifiable when enclosed.

Alternative Embodiments

Figure 8:
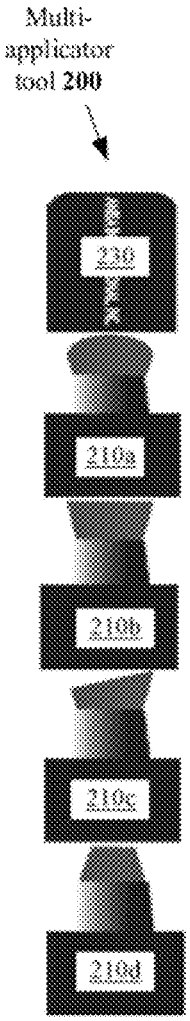
FIG. 8 shows an exploded side view of a multi-applicator tool 200 according to another embodiment of the present invention.
Figure 9:
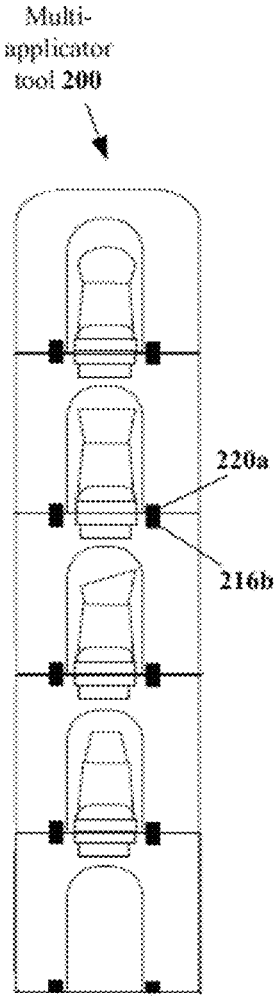
FIG. 9 shows a side sectional view of a capped multi-applicator 200 tool according to an embodiment of the present invention.
Figure 10:
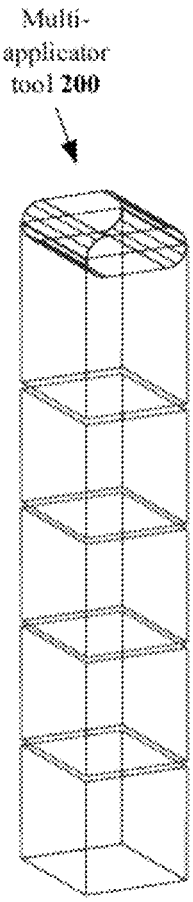
FIG. 10 shows a side perspective view of a capped multi-applicator tool 200 according to an embodiment of the present invention.

Although the applicator bases 15*a*, 15*b*, 15*c*, 15*d* shown in FIGS. 1-7 are cylindrical, bases in other embodiments of the present invention may take other shapes. For example, FIGS. 8-10 depict a multi-applicator tool 200 according to another embodiment of the present invention. As shown in FIGS. 8-9, the multi-applicator tool 200 comprises a plurality of applicators 210*a*, 210*b*, 210*c*, 210*d* and a cap 230. Applicators 210*a*, 210*b*, 210*c*, 210*d* each have a base with a cavity formed through the lower end. Each base has a first magnetic component 216 embedded in the upper surface and a second magnetic component 220 framing the opening of the cavity. The cap 230 has a magnetic component which also frames the opening of a cavity 238. This "framing" may be via a continuous magnet periphery or discrete elements. The first magnetic component 216 of any applicator 210*a*, 210*b*, 210*c*, 210*d* is adapted to magnetically mate with both the second magnetic component 220 of the other applicators and the magnetic component of the cap.

As shown in FIG. 9, the first magnetic component 216*b*, the second magnetic component 220*a*, and the magnetic component 240 in the cap 230 are positioned to align along the same linear axis when the multi-applicator tool 200 is assembled. The cavities 218, 238 may be cylindrical, and the first and second magnetic components 216, 220 may be circular (i.e., rings). However, the cavities could instead be square in cross-section, so that the walls of the base 215 are generally uniform in thickness. The magnetic components in this case could either be square or circular.

The bases 215 and the cap 230 in the present embodiment are square in cross-section so that the multi-applicator tool 200 forms the assembly shown in FIG. 10.

Figure 11:
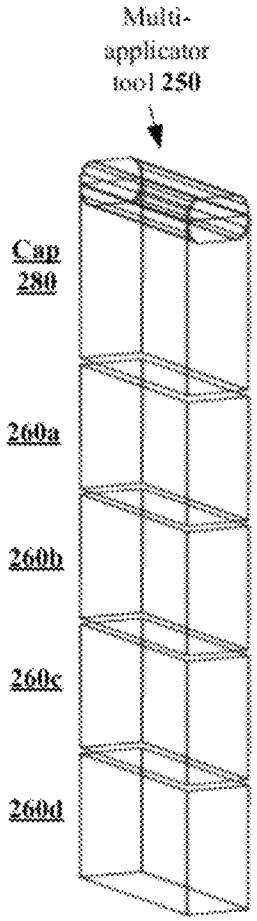
FIG. 11 shows a side perspective view of a capped multi-applicator tool 250 according to another embodiment of the present invention.

In another embodiment, shown in FIG. 11, a multi-applicator tool 250 comprises a plurality of applicators 260*a*, 260*b*, 260*c*, 260*d* each having a base with a rectangular cross-section. In this embodiment, the multi-applicator tool 250 further comprises a cap 280 also having a rectangular cross-section.

Figure 12:
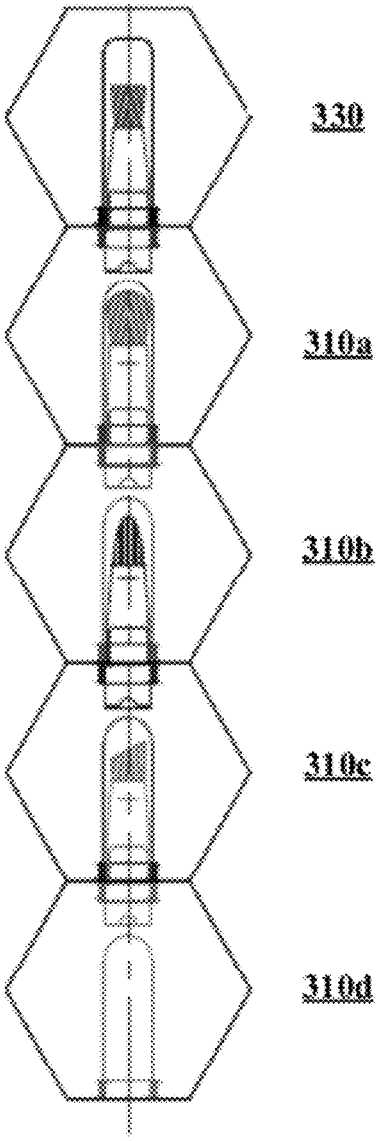
FIG. 12 shows a side sectional view of a capped multi-applicator tool 300 according to an embodiment of the present invention.

FIG. 12 depicts a multi-applicator tool 300 according to another embodiment of the present invention. The multi-applicator tool 300 comprises a plurality of applicators 310*a*, 310*b*, 310*c*, 310*d* and a cap 330. The applicators 310*a*, 310*b*, 310*c*, 310*d* and the cap 330 may each have cross-sections of graduating size, forming the multi-applicator tool 300 having a profile such as that shown in FIG. 12. The applicators 310*a*, 310*b*, 310*c*, 310*d* each have a first magnetic component 316 embedded in the upper surface of the base 315 and a second magnetic component 320 embedded in the lower surface of the base 315.

As shown in FIG. 12, the first and second magnetic components 316, 320 have generally the same shape and are positioned to align along the same linear axis. The second magnetic component 320 frames the opening of a cavity 318 that extends into the base 315. Likewise, the cap 330 has a magnetic component, which also frames the opening of a cavity 338.

Figure 13:
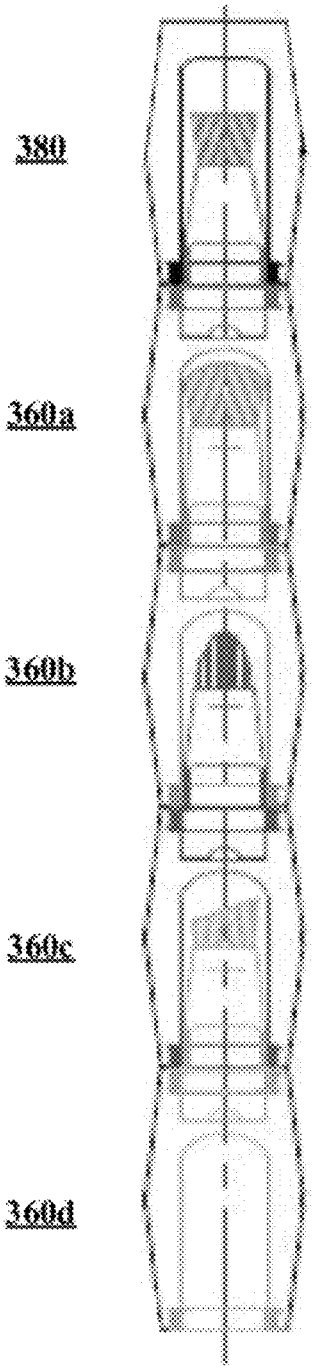
FIG. 13 shows a side sectional view of a capped multi-applicator tool 350 according to another embodiment of the present invention.

FIG. 13 depicts a multi-applicator tool 350 according to another embodiment of the present invention. The multi-applicator tool 350 comprises a plurality of applicators 360*a*, 360*b*, 360*c*, 360*d* and a cap 380. Similar to the applicators 310*a*, 310*b*, 310*c*, 310*d* and the cap 330 forming the multi-applicator tool 300, the cross-sectional shape of the applicators 360*a*, 360*b*, 360*c*, 360*d* and the cap 380 may also have cross-sections of variable size, forming the multi-applicator tool 350 shown in FIG. 13 when assembled.

Figure 14:
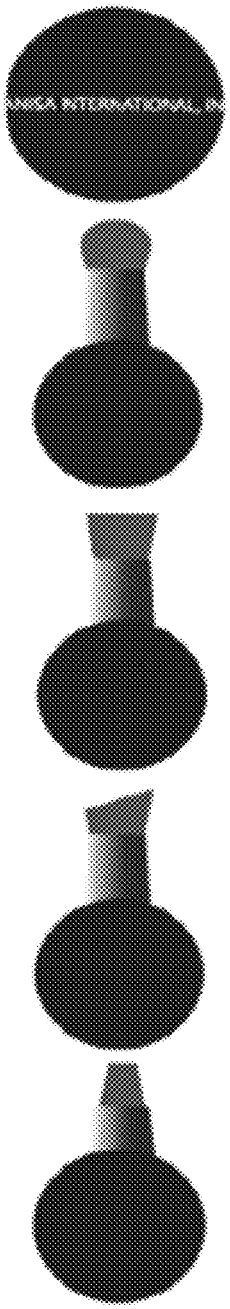
FIG. 14 shows an exploded side view of a multi-applicator tool 500 according to another embodiment of the present invention.
Figure 15:
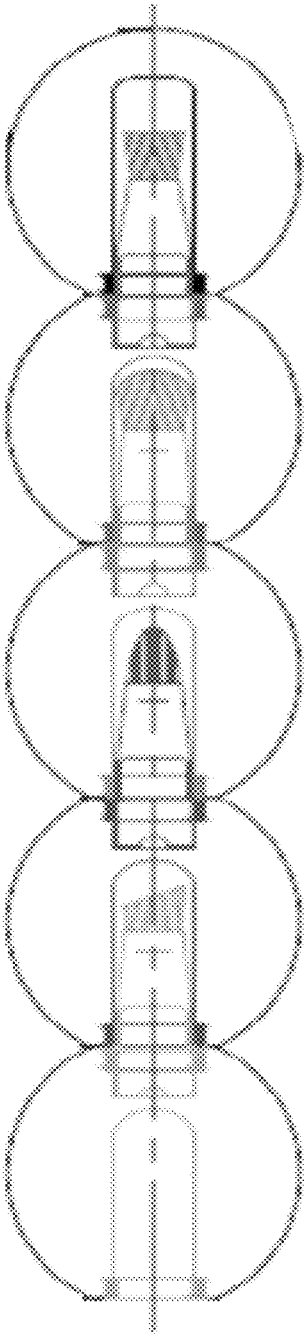
FIG. 15 shows a side sectional view of a capped multi-applicator tool 500 according to an embodiment of the present invention.

FIGS. 14-15 depict another embodiment of the multi-applicator tool of the present invention. The multi-applicator tool 500 comprises a plurality of applicators and a cap. The applicators each have bases which are generally spherical but have flattened mating regions, as shown in FIG. 15. The cap may also be generally spherical with a flattened mating region.

Figure 16:
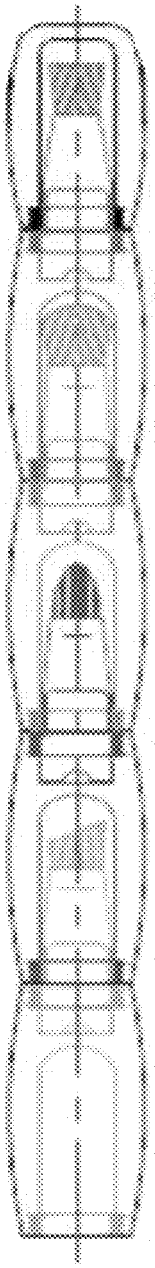
FIG. 16 shows a side sectional view of a capped multi-applicator tool 550 according to another embodiment of the present invention.

FIG. 16 depicts a multi-applicator tool 550 according to another embodiment of the present invention. The multi-applicator tool 550 comprises a plurality of applicators and a cap. The cross-sectional shape of the applicators and the cap may be circles or ovals of graduating sizes.

Figure 17:
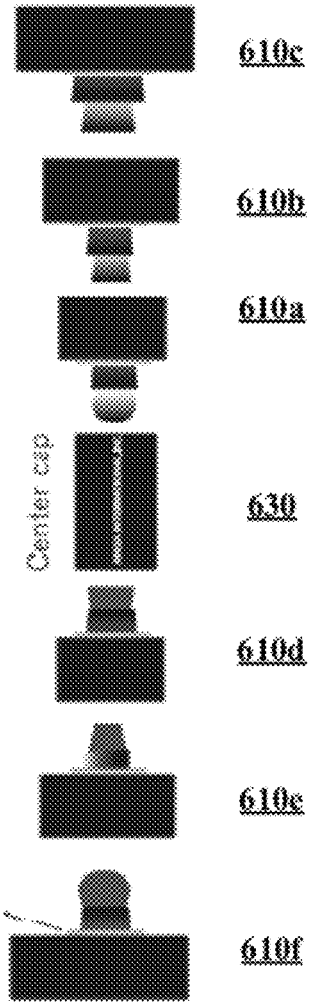
FIG. 17 shows an exploded side view of a multi-applicator tool 600 according to another embodiment of the present invention.
Figure 18:
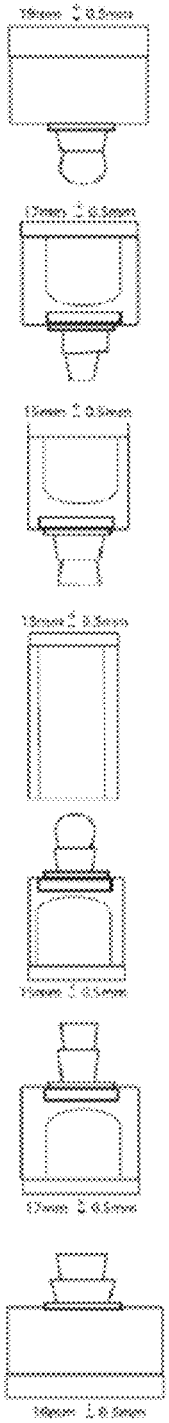
FIG. 18 shows an exploded side sectional view of a multi-applicator tool 600 according to an embodiment of the present invention.
Figure 19:
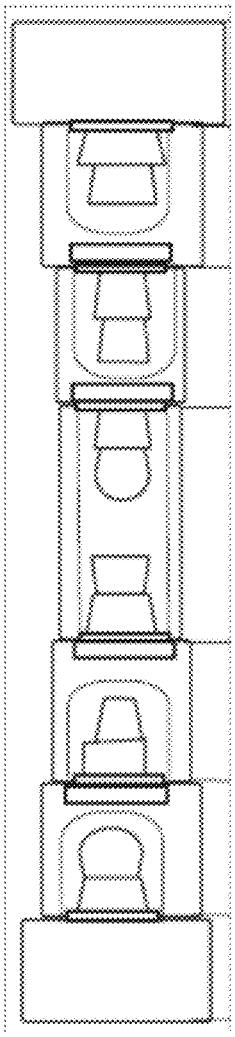
FIG. 19 shows a side sectional view of a capped multi-applicator tool 600 according to an embodiment of the present invention.
Figure 20:
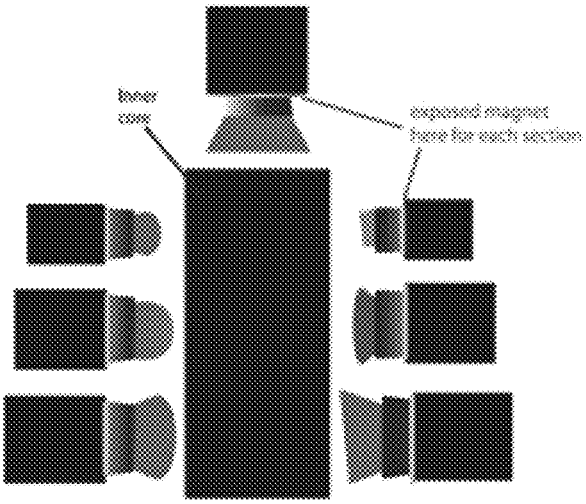
FIG. 20 shows an exploded front view of a multi-applicator tool 700 according to another embodiment of the present invention.

FIGS. 17-19 depict a multi-applicator tool 600 according to another embodiment of the present invention. The multi-applicator tool 600 comprises a plurality of applicators 610*a*, 610*b*, 610*d*, 610*e*, which function in generally the same way as the applicators described with respect to previously discussed multi-applicator tools. However, the multi-applicator tool 600 comprises a dual-sided capping unit 630, which has a magnetic component surrounding an opening for a cavity on each end. In this way, the dual-sided capping unit 630 is capable of receiving an applicator on each end.

The central applicators 610*a*, 610*b*, 610*d*, 610*e* respectively have bases 615*a*, 615*b*, 615*d*, 615*e*, each with a cavity that functions in a similar way as the cavities described above (i.e., configured to contain a brush head). However, the end applicators 610*c*, 610*f* in the present embodiment respectively have bases 615*c*, 615*f*. The bases 615*c*, 615*f* are larger in cross-section than the bases of the central applicators and are solid (i.e., do not have any cavities formed within).

In the present embodiment, the bases vary in size. However, the magnetic components in each base are configured to align along the same linear axis when the cosmetic tool 600 is assembled, allowing the central and end applicators 610*a*, 610*b*, 610*d*, 610*e*, 615*c*, 615*f* to be mated interchangeably.

Figure 21:
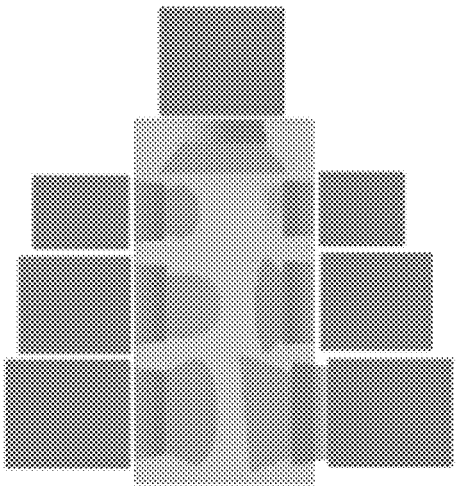
FIG. 21 shows a front view of a multi-applicator tool according to another embodiment of the present invention.
Figure 22:
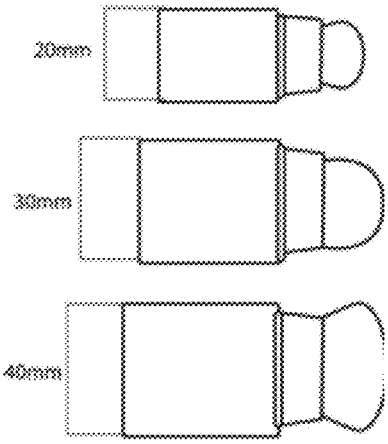
FIG. 22 shows a side view of a set of applicators according to an embodiment 700 of the present invention.

FIGS. 20 through 24 depict a multi-applicator tool 700 according to another embodiment of the present invention. The multi-applicator tool 700 comprises a plurality of applicators and a capping unit. The applicators vary in size. For example, as shown in FIG. 22, one, "top" applicator is 20 millimeters wide, another "middle" applicator is 30 mm wide, and another "lower" applicator is 40 mm wide. Each applicator is comprised of a base with a first magnetic component and a brush head.

Figure 23:
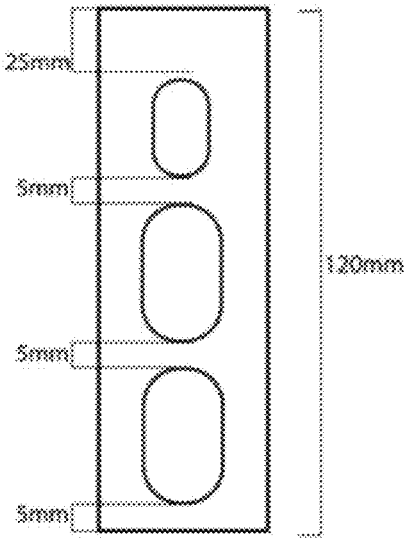
FIG. 23 shows a side view of a capping unit according to an embodiment 700 of the present invention.
Figure 24:
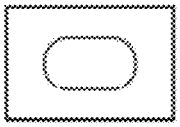
FIG. 24 shows a top view of a capping unit according to an embodiment 700 of the present invention.
Figure 25:
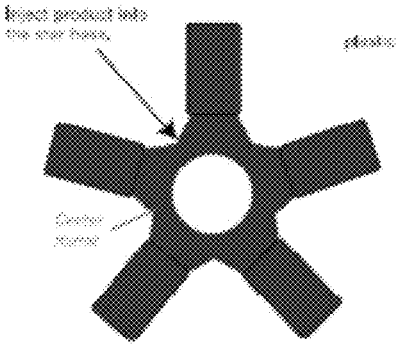
FIG. 25 shows a front view of a multi-applicator tool 800 according to another embodiment of the present invention.
Figure 26:
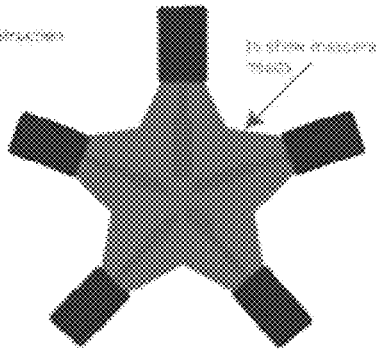
FIG. 26 shows a front view of a multi-applicator tool 800 according to an embodiment of the present invention.
Figure 27:
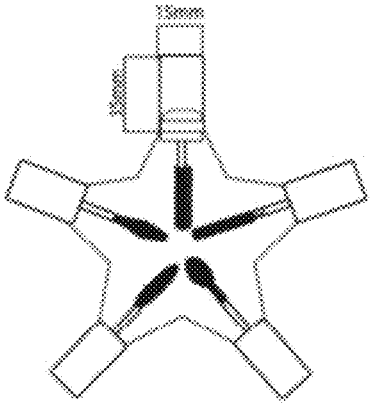
FIG. 27 shows a front sectional view of a multi-applicator tool 800 according to an embodiment of the present invention.
Figure 28:
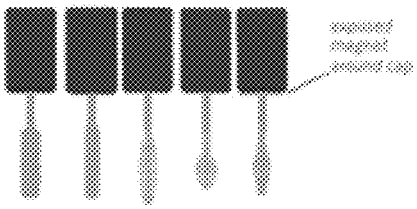
FIG. 28 shows side view of a set of applicator units according to an embodiment 800 of the present invention.
Figure 29:
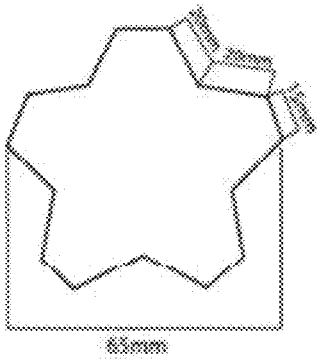
FIG. 29 shows a front view of a capping unit 800 according to an embodiment of the present invention.
Figure 30:
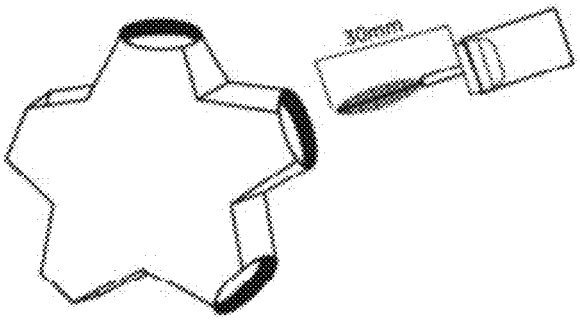
FIG. 30 shows a front perspective view of a capping unit 800 according to an embodiment of the present invention.

The capping unit of multi-applicator tool 700 has cavities on each side, as shown in FIG. 23, as well as a cavity in the top, as shown in FIG. 24. In the present embodiment, the cavities vary in size to accommodate the sizes of the various applicators.

The capping unit of multi-applicator tool 700 is adapted so that the applicators may be magnetically mated to a magnetic rim situated in or around the opening of the cavities. Depending on the size of the cavity and the respective magnetic components, certain of the applicators may be capable of mating with more than one cavity. Alternatively, the side walls forming the capping unit (i.e., the walls surrounding the cavities) may be formed of, or coated with, a ferromagnetic material such that they are adapted to magnetically mate with the magnetic components on the applicators.

The capping unit of multi-applicator tool 700 in various embodiments may be transparent, as shown in FIG. 21. In this way, the brush heads are visible, and therefore can be identified for use, even when the applicators are stored and the brush heads are enclosed within the capping unit.

FIGS. 25-30 depict a multi-applicator tool 800 according to another embodiment of the present invention. The multi-applicator tool 800 comprises a plurality of applicators and a capping unit. The applicators each have a handle holding a brush head. In the present embodiment, the brush heads are varying types of mascara wands, and the capping unit may be filled with, for example, mascara fluid. In this way, the mascara wands can be inserted into the capping unit through various openings and coated with mascara fluid.

In various other embodiments, the brush heads may be configured for other types of makeup applications (e.g., eye shadow, eye liner, lip gloss, cheek blush, etc.), and the capping unit may be empty (i.e., not filled with any product). In addition, in the present embodiment, the capping unit has a single continuous cavity. However, in various other embodiments, the capping unit may have separate cavities for each brush head.

The cavity of multi-applicator tool 800 has a plurality of openings into the cavity that are adapted to each receive one of the brush heads. In the present embodiment, the brush heads are interchangeable (i.e., can be inserted into any of the cavities). Surrounding the opening of each cavity is a magnetic component, which is designed to magnetically mate with a magnetic component located on the handle of each applicator.

In various embodiments, depending on the viscosity of the mascara fluid, the capping unit may have a fluid retention element. For example, each opening may be at least in part covered by a gasket adapted to prevent leakage of the mascara fluid or other products filling the cavity.

Those skilled in the art will understand that the brush heads can be arranged using the concepts of the present invention in ways other than the ways depicted in the figures. For example, any of the cosmetic applicators shown in the figures may be formed using either additional or fewer brush heads. Furthermore, the individual brush heads may take shapes other than those depicted in the figures. In addition, the cosmetic applicator may also take shapes other than those depicted in the figures.

Manufacturing Techniques

Assembly is generally as follows.

Figure 31:
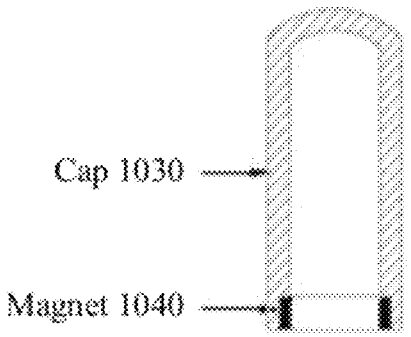
FIGS. 31 and 32 show exemplary elements used in the discussion of manufacturing techniques.

For an exemplary Cap 1030 shown in FIG. 31, the main body of the cap is injection molded with a suitable plastic such as a plastic known in the art. Prior to the injection molding process, the exemplary magnet 1040 shown in FIG. 31 is inserted into the mold such that the magnet is molded in place. No glue is needed although it could be used in an alternate embodiment.

Figure 32:
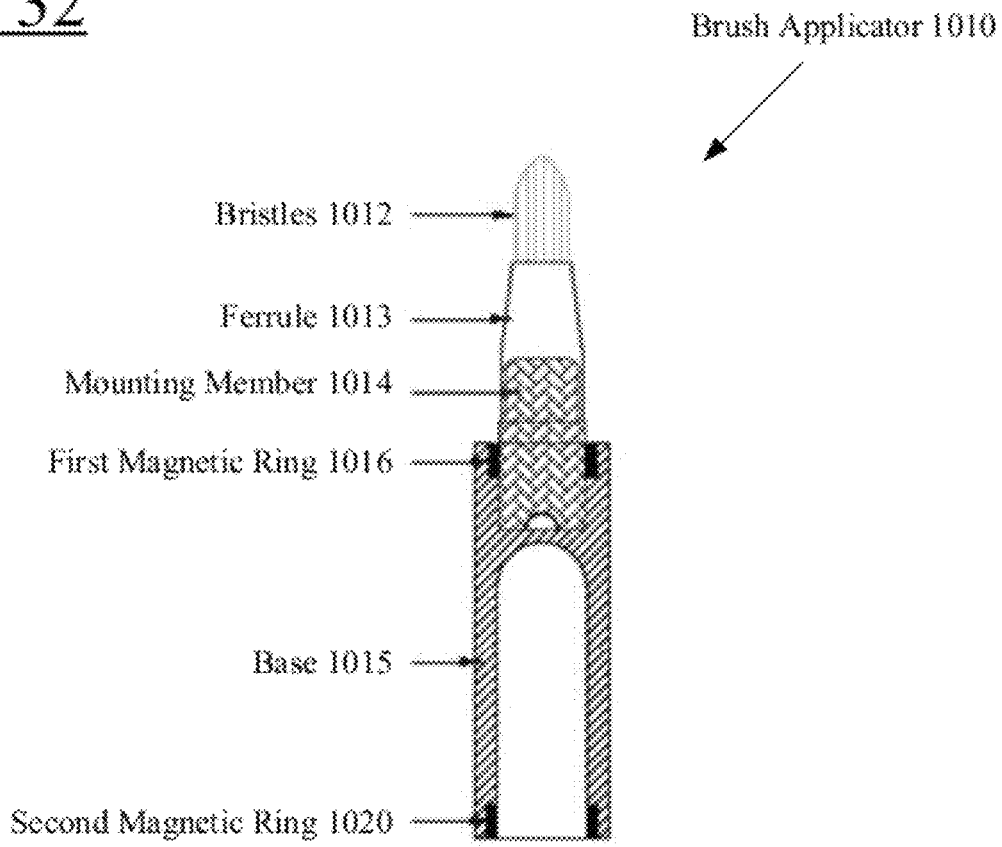

For an exemplary brush applicator 1010 shown in FIG. 32, the main body is injection molded with a suitable plastic such as a plastic known in the art. Prior to the injection molding process, the exemplary magnet 1020 is inserted into the mold such that the magnet 1020 is molded in place. Separately, the mounting member 1014, ferrule 1013, and brush bristles 1012 are assembled together as a subassembly. The first magnet 1016 is then put in place in the base 1015 as shown in FIG. 32, and then the subassembly is inserted into the position shown in FIG. 32. Glue holds the various elements together as needed.

CONCLUSION

Many modifications and other embodiments of the present invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An applicator member configured to interact with another similar applicator member having the same components claimed herein, said applicator member being elongate, having a longitudinal axis, and comprising:

an elongate applicator head having a longitudinal axis substantially common to said longitudinal axis of said elongate applicator member, and including an elongate applicator element; and an elongate base having a longitudinal axis substantially common to said longitudinal axis of said elongate applicator member, and also having a first end and a second end opposing said first end, said applicator head fixed proximate said first end of said base such that an exposed shoulder surface portion is defined by said first end of said base, said first exposed shoulder surface being at least partially defined by a first attraction element itself also being part of said elongate base, said second end of said base defining an exposed peripheral end surface portion being at least partially defined by a second attraction element itself also being part of said elongate base, said second end of said base also defining an open elongate cavity having a longitudinal axis substantially common to said longitudinal axis of said elongate applicator member, said exposed peripheral end surface portion being peripherally located about the opening of said elongate cavity, said first attraction element of said applicator member configured to be selectively attached and selectively detached from a second attraction element of said another similar applicator member such that said applicator element of said applicator member can fit within a cavity of said another similar applicator member during said attachment of said first and second attraction elements by an attraction force, said second attraction element of said applicator member configured to be selectively attached and selectively detached from a first attraction element of said another similar applicator member such that said cavity of said applicator member allows an applicator element of said another similar applicator member to fit therein during said attachment of said first and second attraction elements by an attraction force.

2. The applicator member as claimed in claim 1, wherein said attraction force between said first and second elements is a magnetic force.

3. The applicator member as claimed in claim 1, wherein at least one of said first and second attraction elements is a magnet.

4. The applicator member as claimed in claim 1, wherein at least a portion of said open elongate cavity is substantially circular in transverse cross section.

5. The applicator member as claimed in claim 1, wherein one of said first attraction elements is a ring-shaped magnet.

6. An applicator member configured to interact with another similar applicator member having the same components claimed herein, said applicator member being elongate, having a longitudinal axis, and comprising:

an elongate applicator head having a longitudinal axis substantially common to said longitudinal axis of said elongate applicator member, and including an elongate applicator element and an elongate mounting member; and an elongate base having a longitudinal axis substantially common to said longitudinal axis of said elongate applicator member, and also having a first end and a second end opposing said first end, said applicator head fixed proximate said first end of said base such that an exposed shoulder surface portion is defined by said first end of said base, said first exposed shoulder surface being at least partially defined by a first attraction element itself also being part of said elongate base, said second end of said base defining an exposed peripheral end surface portion being at least partially defined by a second attraction element itself also being part of said elongate base, said first end of said base also defining an open elongate cavity having a longitudinal axis substantially common to said longitudinal axis of said elongate applicator member and configured to accept at least a portion of said elongate mounting member, said exposed shoulder surface portion being peripherally located about the opening of said elongate cavity, said second end of said base also defining an open elongate cavity having a longitudinal axis substantially common to said longitudinal axis of said elongate applicator member, said exposed peripheral end surface portion being peripherally located about the opening of said elongate cavity, said first attraction element of said applicator member configured to be selectively attached and selectively detached from a second attraction element of said another similar applicator member such that said applicator element of said applicator member can fit within a cavity of said another similar applicator member during said attachment of said first and second attraction elements by an attraction force, said second attraction element of said applicator member configured to be selectively attached and selectively detached from a first attraction element of said another similar applicator member such that said cavity of said applicator member allows an applicator element of said another similar applicator member to fit therein during said attachment of said first and second attraction elements by an attraction force.

7. The applicator member as claimed in claim 6, wherein said attraction force between said first and second elements is a magnetic force.

8. The applicator member as claimed in claim 6, wherein at least one of said first and second attraction elements is a magnet.

9. The applicator member as claimed in claim 6, wherein at least a portion of said open elongate cavity is substantially circular in transverse cross section.

10. The applicator member as claimed in claim 6, wherein one of said first attraction elements is a ring-shaped magnet.

11. The applicator member as claimed in claim 6, wherein said applicator member is a brush head.

12. The applicator member as claimed in claim 6, wherein said brush head includes bristles, a ferrule, and said mounting member.

13. A multi-applicator tool member including a plurality of applicators configured to interact with and attach to each other in order to combine to provide said tool, said multi-applicator tool member being elongate, having a longitudinal axis, and comprising:

A) a first applicator itself including:

1) an elongate applicator head having a longitudinal axis substantially common to said longitudinal axis of said elongate tool member, and including an elongate applicator element and an elongate mounting member; and 2) an elongate base having a longitudinal axis substantially common to said longitudinal axis of said elongate applicator member, and also having a first end and a second end opposing said first end, said applicator head fixed proximate said first end of said base such that an exposed shoulder surface portion is defined by said first end of said base, said first exposed shoulder surface being at least partially defined by a first attraction element itself also being part of said elongate base, said second end of said base defining an exposed peripheral end surface portion being at least partially defined by a second attraction element itself also being part of said elongate base, said first end of said base also defining an open elongate cavity having a longitudinal axis substantially common to said longitudinal axis of said elongate tool member and configured to accept at least a portion of said elongate mounting member, said exposed shoulder surface portion being peripherally located about the opening of said elongate cavity, said second end of said base also defining an open elongate cavity having a longitudinal axis substantially common to said longitudinal axis of said elongate tool member, said exposed peripheral end surface portion being peripherally located about the opening of said elongate cavity; and B) a second applicator itself including the same limitations as does said first applicator, said first attraction element of said first applicator member configured to be selectively attached and selectively detached from the second attraction element of said second applicator member such that said applicator element of said first applicator member fits within a cavity of said another similar applicator member during said attachment of said first attraction element of said first applicator member and said second attraction element of said second applicator member by an attraction force, said second attraction element of said first applicator member configured to be selectively attached and selectively detached from a first attraction element of said second applicator member such that said cavity of said first applicator member allows an applicator element of said second applicator member to fit therein during said attachment of said second attraction element of said first applicator member and said first attraction element of said second applicator member by an attraction force.

14. The multi-applicator tool member as claimed in claim 13, wherein said base of said first applicator and said base of said second applicator combine together to provide a common elongate member.

15. A multi-applicator tool member including a plurality of applicators configured to interact with and attach to a singular central unit, said multi-applicator tool member comprising:

a dual-sided capping unit having a magnetic component surrounding an opening for a cavity on each end, such that a first magnetic component surrounds an opening for a cavity on a first end of said unit and a second magnetic component surrounds an opening for a cavity on a second end of said unit, said second end being opposite said first end;

a first applicator configured to interact with said first end of said capping unit and retained thereby; and a second applicator configured to interact with said second end of said capping unit and retained thereby, such that said first applicator, said second applicator, and said dual-sided capping unit are configured to align along the said linear axis when assembled.

* * * * *